US007573434B2

(12) United States Patent
Le Bayon et al.

(10) Patent No.: US 7,573,434 B2
(45) Date of Patent: Aug. 11, 2009

(54) DECOUPLING ARRAYS FOR RADIATING ELEMENTS OF AN ANTENNA

(75) Inventors: Armel Le Bayon, Saint Nazaire (FR); Denis Tuau, Trignac (FR); Alain Bouhet, Saint Nazaire (FR)

(73) Assignee: Alcatel Lucent, Paris (FR)

( * ) Notice: Subject to any disclaimer, the term of this patent is extended or adjusted under 35 U.S.C. 154(b) by 0 days.

(21) Appl. No.: 11/867,551

(22) Filed: Oct. 4, 2007

(65) Prior Publication Data

US 2008/0084358 A1 Apr. 10, 2008

(30) Foreign Application Priority Data

Oct. 9, 2006 (FR) ..... 06 54140

(51) Int. Cl.
*H01Q 9/16* (2006.01)

(52) U.S. Cl. ..... 343/797; 343/893

(58) Field of Classification Search ..... 343/824, 343/793, 797, 893
See application file for complete search history.

(56) References Cited

U.S. PATENT DOCUMENTS 3,995,274 A * 11/1976 Schwartz et al. ..... 343/771
6,239,764 B1 * 5/2001 Timofeev et al. ..... 343/795
2005/0062673 A1 * 3/2005 Wu et al. ..... 343/872
2005/0206575 A1 * 9/2005 Chadwick et al. ..... 343/797

FOREIGN PATENT DOCUMENTS

| | | | |
|---|---|---|---|
| EP | 0720252 | A1 | 7/1996 |
| GB | 2338346 | A | 12/1999 |
| WO | WO 02/50953 | A1 | 6/2002 |
| WO | WO 02/084790 | A1 | 10/2002 |
| WO | WO 03/019717 | A2 | 3/2003 |
| WO | WO2006133609 | A1 * | 12/2006 |

OTHER PUBLICATIONS

Bayard J P R, et al.: "E-Plane Scan Performance of Infinite Arrays of Dipoles Printed on Protruding Dielectric Substrates: Coplanar Feed Line and E-Plane Metallic Wall Effects" IEEE Transactions on Antennas and Propagation, IEEE Service Center, Piscataway, NJ, US, vol. 41, No. 6, Jun. 1, 1993, pp. 837-841, XP000387376.

* cited by examiner

*Primary Examiner*—Trinh V Dinh
*Assistant Examiner*—Dieu Hien T Duong
(74) *Attorney, Agent, or Firm*—Fay Sharpe LLP

(57) ABSTRACT

The present invention consists in an antenna including at least two arrays of radiating elements disposed linearly and parallel, plane metal screens being interleaved between the arrays. According to the invention screening means, added above the radiating elements, comprise criss-cross metal filaments forming a grid and adapted always to be placed between two radiating elements.

12 Claims, 3 Drawing Sheets

DECOUPLING ARRAYS FOR RADIATING ELEMENTS OF AN ANTENNA

CROSS-REFERENCE TO RELATED APPLICATIONS

This application is based on French Patent Application No. FR 0654140 filed Oct. 9, 2006, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a telecommunication antenna, used in particular for cellular telephony. This kind of antenna is formed of arrays of closely spaced radiating elements.

2. Description of the Prior Art

Antennas of this type are obtained by means of the printed circuit technique and consist of parallel arrays of dipoles that are placed in a casing serving as a reflector. These antennas, usually called "patch" antennas, are widely used at present because of their very small overall size, their extremely simple fabrication technology, and their moderate cost, because they are mass produced.

These antennas nevertheless are subject to production difficulties because of conflicts that exist between the various design criteria. In particular, although the mutual coupling that can occur between the individual radiating elements when they are close together improves the performance of the antenna, it also has certain negative effects, such as distortion of the spectrum of the antenna or modification of the input impedance of the elements for a given frequency. It is therefore a question of limiting this coupling without significantly increasing either the weight or the overall size of the antenna.

In order to preserve uniformity of radiation, it is necessary to maintain decoupling of good quality between the arrays of dipoles. The arrays of dipoles are usually isolated from each other by simple metal walls forming screens. One solution for obtaining improved decoupling is to increase the height of the screen to block electromagnetic transmission between the elements. However, if the walls are very close together, the radiating elements are confined within a small space created by the screens at which multiple reflections occur that reduce the bandwidth. This degrades the performance of the antenna, in particular the standing wave ratio (SWR), which is reflected in a mismatch between the input impedance of the antenna and that of the transmitter (in the case of transmission). It is linked to the modulus of the coefficient of reflection of the antenna.

To solve this problem, it has been proposed to dispose radiating elements side by side on a reflector, for example. A conductive metal line placed in the same plane as the elements and connected to ground and to the reflector surrounds the radiating elements. The radiating elements and the metal line can in particular be produced by etching a layer of copper covering a dielectric layer.

This embodiment applies only to elements contained entirely within a plane parallel to that of the reflector. This solution is not applicable to radiating elements that are in a plane perpendicular to the reflector, as is the case with dipoles. The mechanical structure to be used in this case is complex and costly.

An object of the present invention is to eliminate the drawbacks of the prior art, and in particular to minimize the reflections that exist between the metal walls of the antennas and the radiating elements, at the same time as maintaining a high level of decoupling without reducing the frequency band.

SUMMARY OF THE INVENTION

The present invention consists in an antenna including at least two arrays of radiating elements disposed linearly and parallel, plane metal screens being interleaved between the arrays. According to the invention, screening means are added above the radiating elements. These screening means comprise crisscross metal filaments forming a grid and adapted always to be placed between two radiating elements.

The screening means are disposed in a plane perpendicular to that of the metal screens separating the arrays, and thus in a plane perpendicular to the arrays.

In one embodiment of the invention, the crisscross filaments form a grid extending over the entire width of the antenna. They extend over the transverse dimension of the antenna so as to cross the screens and the parallel arrays. The number of filaments used depends on the level of isolation required. The filaments are advantageously fixed to the lateral walls.

The width of the filaments is preferably from one fifteenth ($1/15^{th}$) to one twenty fifth ($1/25^{th}$) of the wavelength at the center frequency, and preferably of the order of one twentieth ($1/20^{th}$) of the wavelength.

The metal filaments have a negligible influence on the SWR but significantly improve the decoupling between the array elements with a gain that can be as high as 3 to 5 dB. In parallel with this, the height of the metal screens can be limited to the value sufficient to obtain a satisfactory SWR over the frequency band.

An additional advantage of the present invention is that it contributes to the mechanical stiffness of the antenna.

The present invention applies to base station antennas for mobile telephony in general, and in particular WiMax (Worldwide Interoperability for Microwave Access) applications.

Other features and advantages of the present invention will become apparent on reading the following description of one embodiment, given by way of illustrative and nonlimiting example, of course, and from the appended drawings.

DETAILED DESCRIPTION OF THE PREFERRED EMBODIMENT

Figure 1:
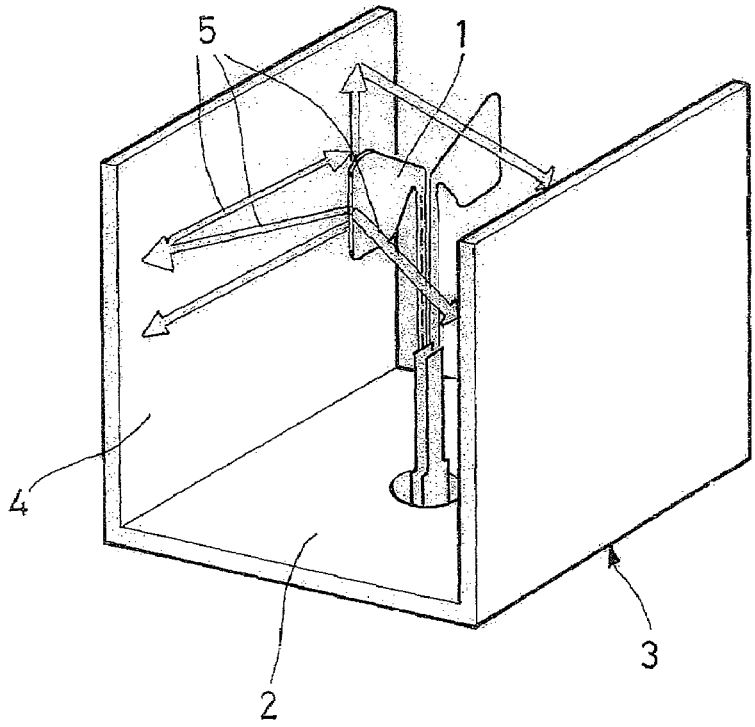
FIG. 1 is a diagrammatic representation of a radiating element in a confined environment.

FIG. 1 represents a unit dipole 1 fixed to the bottom 2 of the casing 3 of an antenna and surrounded by metal screens 4. The arrows 5 symbolize the multiple reflections that occur at the screens 4 because of their proximity.

Figure 2:
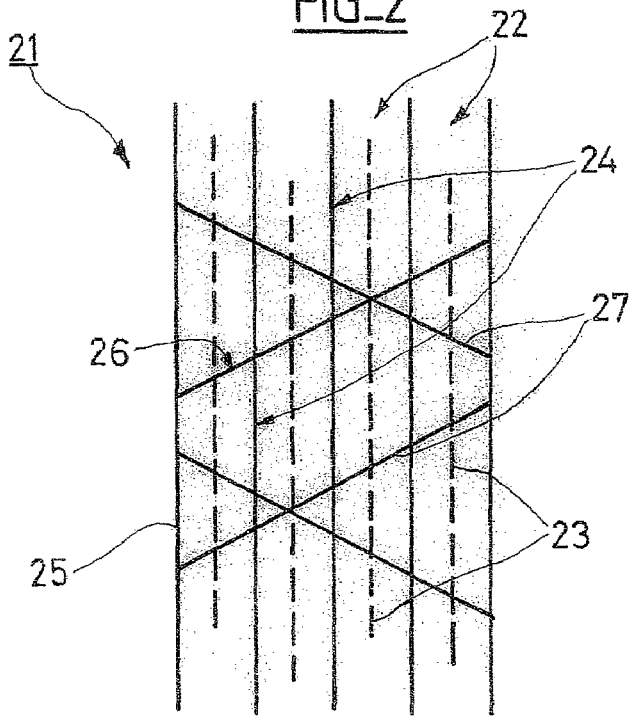
FIG. 2 is a diagram showing an antenna of the invention.

FIG. 2 is a diagram of an antenna 21 according to the present invention. The antenna 21 comprises four arrays 22 made up of unit radiating elements 23. The arrays 22 form parallel rows separated by screens 24 and framed by the lateral walls 25 of the casing of the antenna 21. The screening means 26, disposed above the arrays 22, are here made up of filaments 27 fixed to the lateral walls 25 so as to be positioned over areas in which there is no radiating element 23, in order not to disturb the SWR. In the present case in which the arrays 22 each include six dipoles 23, it suffices to use four filaments 27 to achieve the required isolation performance.

Figure 3A:
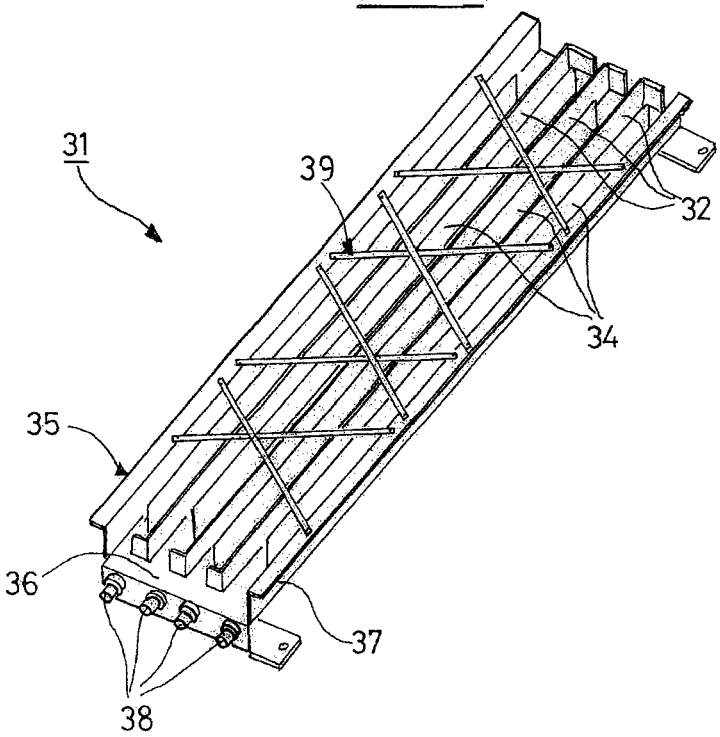
FIGS. 3A and 3B represent one embodiment of the invention.
Figure 3B:
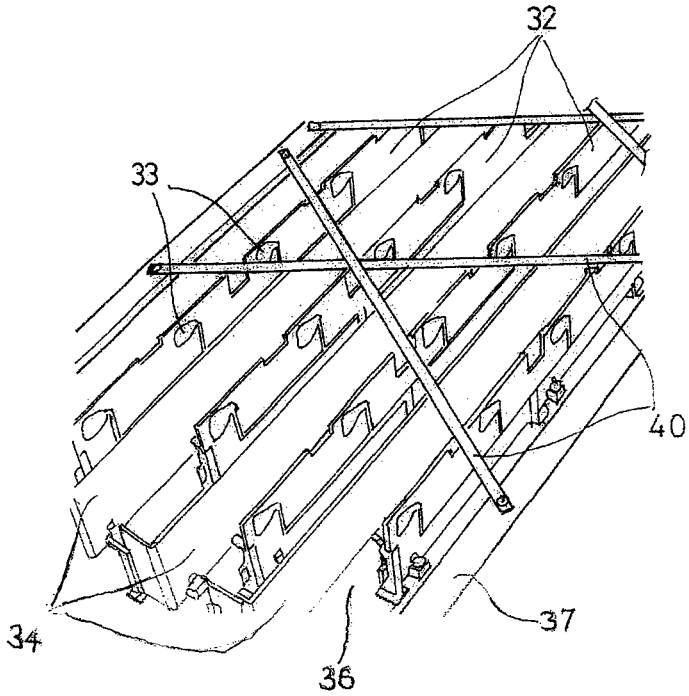

In the embodiment of the invention shown in FIGS. 3A and 3B, there is represented an antenna 31 according to the invention comprising four arrays 32 of aligned individual radiating elements or dipoles 33, forming plane and parallel rows. The radiating element 33 is produced on a printed circuit. For reasons of radio-frequency performance, the distance separating the arrays 32 is one half-wavelength. To reduce the coupling, the arrays 32 are such that the radiating elements 33 are offset relative to each other by one half-wavelength.

Between and parallel to the arrays 32 are disposed metal screens 34 having a height of the same order as the height of the arrays. The antenna 31 includes a casing 35 forming a base 36 and laterals walls 37 for the arrays 32 and the screens 34. The casing 35 carries four input connectors 38 each corresponding to one of the four arrays 32 of radiating elements 33 that are represented here.

According to the invention, screening means 39 are further disposed above the elements 32 and the screens 34. These means 39 are made up of criss-cross metal filaments 40 forming a grid. The filaments 40 extend the whole width of the antenna and are disposed between two radiating elements 33 so as not to disturb the SWR. In the present case these means 39 are in a plane perpendicular to the plane of the screens 34 and the arrays 32, thus closing the casing 35. The width of the filaments 40 is of the order of one twentieth ($1/20^{th}$) of the wavelength.

Figure 4A:
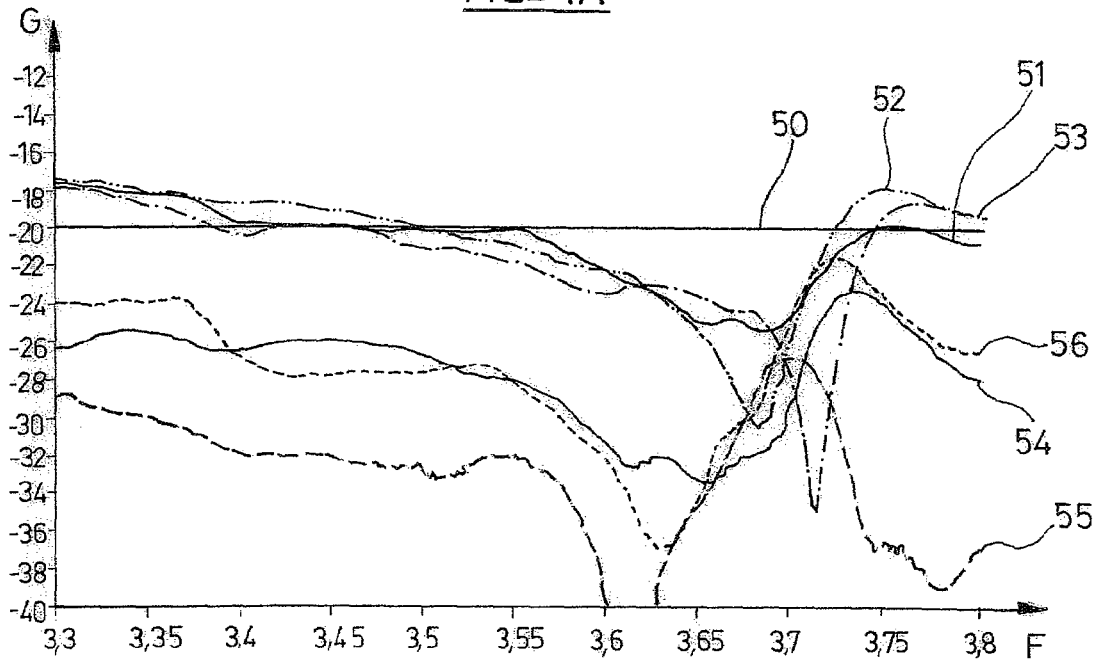
FIGS. 4A and 4B are curves showing the decoupling between the arrays of radiating elements respectively for a prior art antenna and for an antenna according to the invention; the amplitude A in decibels (dB) is plotted on the ordinate axis and the frequency F in gigahertz (GHz) is plotted on the abscissa axis.
Figure 4B:
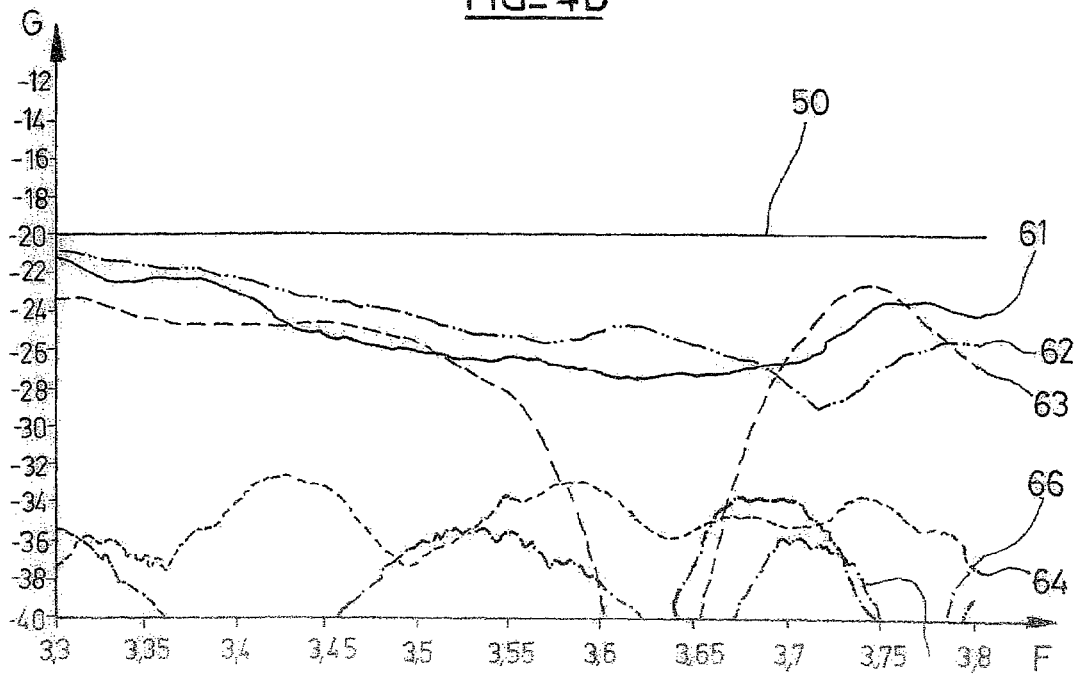

FIGS. 4A and 4B respectively show the performance obtained with a prior art antenna and an antenna according to the invention. The line 50 represents the amplitude reference line of the applicable specifications, i.e. 20 dB. The curves 51-56 on the one hand and 61-66 on the other hand correspond to measurements effected at the input connectors of the antenna taken two by two. The curves 51-56 obtained with a prior art antenna must be compared one by one with the respective curves 61-66 obtained with an antenna according to the invention. It is found that the curves 61-66 have an amplitude less than the curves 51-56, reflecting an improvement in the decoupling between the arrays.

The present invention is not limited to the embodiments that have been described explicitly, but encompasses diverse variants and generalizations thereof that will be evident to the person skilled in the art. In particular, without departing from the scope of the invention, the screening means can be fastened to the radome that protects the radiating structure of the antenna, in particular in the form of strips of metal having the characteristics of the filaments described hereinabove that are fixed (stuck) to the internal face of the radome.

There is claimed:

1. An antenna including:

at least two arrays of radiating elements disposed linearly and parallel, plane metal screens being interleaved between the arrays, wherein the plane metal screens include a plurality of lateral walls of a casing of the antenna;

screening means added above the radiating elements, said screening means comprising criss-cross metal filaments forming a grid and adapted to be placed always between two radiating elements;

wherein the criss-cross metal filaments are fixed to the plurality of the lateral walls so as to be positioned over areas in which there is no radiating element.

2. The antenna according to claim 1, wherein the screening means are disposed in a plane perpendicular to that of the metal screens between the arrays.

3. The antenna according to claim 1, wherein the criss-cross filaments forming the grid extend over the entire width of the antenna.

4. The antenna according to claim 1, wherein the width of the filaments is from one fifteenth to one twenty-fifth of the wavelength at the center frequency.

5. The antenna according to claim 1, wherein the distance between the arrays is of the order of one half-wavelength.

6. The antenna according to claim 1, wherein the arrays form parallel rows separated by the metal screens and framed by the plurality of the lateral walls of the casing of the antenna.

7. The antenna according to claim 1, wherein the metal screens have a height substantially equal to a height of the arrays.

8. A telecommunications antenna for cellular telephony, the antenna comprising:

four arrays of radiating elements disposed linearly and parallel;

metal screens being interleaved between the arrays, wherein the arrays form parallel rows separated by the metal screens and framed by a plurality of lateral walls of a casing of the antenna; and screening means added above the radiating elements, the screening means comprising criss-crossed metal filaments forming a grid extending over the entire width of the antenna and disposed between two radiating elements; wherein the criss-cross metal filaments are fixed to the lateral walls so as to be positioned over areas in which there is no radiating element.

9. The telecommunication antenna according to claim 8, wherein the screening means are disposed in a plane perpendicular to that of the metal screens between the arrays.

10. The telecommunication antenna according to claim 8, wherein the width of the filaments is from one fifteenth to one twenty-fifth of the wavelength at the center frequency.

11. The telecommunication antenna according to claim 8, wherein the distance between the arrays is on the order of one half-wavelength.

12. The telecommunication antenna according to claim 8, wherein the metal screens have a height substantially equal to a height of the arrays.

* * * * *